United States Patent [19]

Girard et al.

[11] Patent Number: 5,072,548

[45] Date of Patent: Dec. 17, 1991

[54] PROCESS AND APPARATUS FOR FINISH GRINDING SPLINES OR GEAR TEETH

[75] Inventors: Francis Girard, Viroflay; Christian J. A. Marceau, Cergy St Cristophe; Jean-Pierre G. Pouget, Argenteuil, all of France

[73] Assignee: Societe Anonyme Dite Hispano Suiza, Saint Cloud Cedex, France

[21] Appl. No.: 672,868

[22] Filed: Mar. 20, 1991

Related U.S. Application Data

[62] Division of Ser. No. 476,778, Feb. 7, 1990, Pat. No. 5,042,205.

[30] Foreign Application Priority Data

Feb. 8, 1989 [FR] France ..... 89 01600

[51] Int. Cl.[5] ..... B24B 49/00

[52] U.S. Cl. ..... 51/165.87; 51/165.88; 51/5 D; 125/11.03; 125/11.06

[58] Field of Search ..... 51/165.87, 165.88, 165.71, 51/165.74, 165.75, 5 D; 125/11.03, 11.06; 356/376, 371

[56] References Cited

U.S. PATENT DOCUMENTS

| | | | |
|---|---|---|---|
| 3,090,171 | 5/1963 | Stimson . | |
| 4,158,507 | 6/1979 | Himmel . | |
| 4,295,301 | 10/1981 | Barth et al. . | |
| 4,359,841 | 11/1982 | Barth et al. . | |
| 4,483,103 | 11/1984 | Bickel | 51/165.87 |
| 4,551,950 | 11/1985 | Unno et al. | 51/165.87 |
| 4,558,686 | 12/1985 | Ono | 51/165.87 |
| 4,571,891 | 2/1986 | Donner | 51/165.87 |

FOREIGN PATENT DOCUMENTS

| | | |
|---|---|---|
| 195405 | 9/1986 | European Pat. Off. . |
| 2517237 | 6/1983 | France . |
| 359343 | 2/1962 | Switzerland . |

*Primary Examiner*—M. Rachuba
*Attorney, Agent, or Firm*—Bacon & Thomas

[57] ABSTRACT

A process and apparatus for finish grinding splines or teeth on workpieces is disclosed which includes a device to check the cross-sectional shape of the grinding portion of the grinding wheel between grinding steps. When a grinding wheel is withdrawn from the workpiece, the cross-sectional contour of the grinding wheel is checked. The device for dressing or sharpening the grinding wheel is controlled by data generated by the checking of the cross-sectional contour of the grinding wheel so that the desired contour is maintained. After being withdrawn from the workpiece, the grinding wheel contacts a strip of metal foil to leave an impression of its contour. A checking head mounted on the device checks the contour of the impression left in the metal foil. The checking head is connected to a computer unit which, in turn, controls the operation of the sharpening or dressing device.

9 Claims, 12 Drawing Sheets

PROCESS AND APPARATUS FOR FINISH GRINDING SPLINES OR GEAR TEETH

This application is a division of application Ser. No. 476,778, filed Feb. 7, 1990, now U.S. Pat. No. 5,042,205.

FIELD OF THE INVENTION

This invention relates to a process and apparatus for finish grinding splines or gear teeth on a workpiece. More specifically, the invention involves a process and apparatus for grinding workpieces having high dimensional accuracy requirements and includes a device for determining the cross sectional shape of the grinding wheel which is used to control the sharpening of the wheel.

High-precision grinding machines are known in the art and typically have a grinding wheel with at least the peripheral portion having a desired cross-sectional shape Each time the grinding wheel contacts the workpiece, a portion of the wheel is worn away, which changes its dimensions. The known devices have included means for monitoring the dimensions of the grinding wheel and also include sharpening devices to sharpen and shape the wheel between grinding operations. When the wheel has become significantly worn, it must be replaced.

French Patent 2,517,237 illustrates a grinding apparatus that is automatically controlled by a computer device. This apparatus includes a grinding device with a grinder wheel, which is automatically controlled by the computer.

U.S. Patents to Barth et al. (U.S. Pat. Nos. 4,295,301 and 4,359,841) disclose a process and an apparatus for dressing or sharpening a grinding wheel which is controlled by a device that detects the wear of the wheel by a contact sensor.

The U.S. Patent to Himmel (U.S. Pat. No. 4,158,507) as well as European Patent 0195405 disclose systems for monitoring the contours of workpieces utilizing a laser beam light source.

The known systems have not been able to achieve the required accuracy of monitoring the shape of the grinding wheel without unduly delaying the grinding operations These systems have been found inadequate to finish grind splines or teeth on workpieces that must be formed with extremely close tolerances as required in such workpieces intended for aeronautical applications.

SUMMARY OF THE INVENTION

The present invention relates to a grinding process and apparatus for finish grinding splines or teeth on workpieces which must be machined and finished to very critical tolerances The invention includes means to check the cross-sectional shape of the grinding portion of the grinding wheel between grinding steps without causing undue delay between such process steps.

The grinding wheel is movable axially with respect to the workpiece to finish grind the splines or gear teeth. When the grinding wheel is withdrawn from the workpiece, the cross-sectional contour of the grinding wheel is checked. The device for dressing or sharpening the grinding wheel is controlled by data generated by the checking of the cross-sectional contour of the grinding wheel so that the desired contour is maintained.

After being withdrawn from the workpiece, the grinding wheel contacts a strip of metal foil to leave an impression of its contour. A checking head mounted on the device checks the contour of the impression left in the metal foil. The checking head is connected to a computer unit which, in turn, controls the operation of the sharpening or dressing device.

In a first embodiment, the checking head comprises a laser diode emitting a laser beam onto the contour such that the image of the contour is formed on a light sensitive plate which is connected to the computer to transfer data relating to the impression contour.

In a second embodiment, the metal foil bearing the impression of the grinding wheel contour is clamped between a pair of clamping plates formed of electrically insulating material, but having electrically conductive coatings in contact with the metal foil. The checking head has an electrically conducting wire extending between a pair of fingers projecting from an arm. A voltage source is connected to the wire such that, as the assembly is moved into contact with the contour of the impression on the foil, a voltage is detected on the clamping plate coatings. Data relating to the position of the arm when the voltage is detected is transferred to the computer to control the sharpening device.

In a third embodiment, the checking head may comprise a known optical device which plots the impression of the contour formed in the metal foil by photo-sensing.

BRIEF DESCRIPTION OF THE DRAWINGS

FIG. 3*a* is an illustration of the computer screen showing the profile constructed from data transmitted to it via the light sensitive plate.

DETAILED DESCRIPTION OF THE PREFERRED EMBODIMENTS

Figure 1:
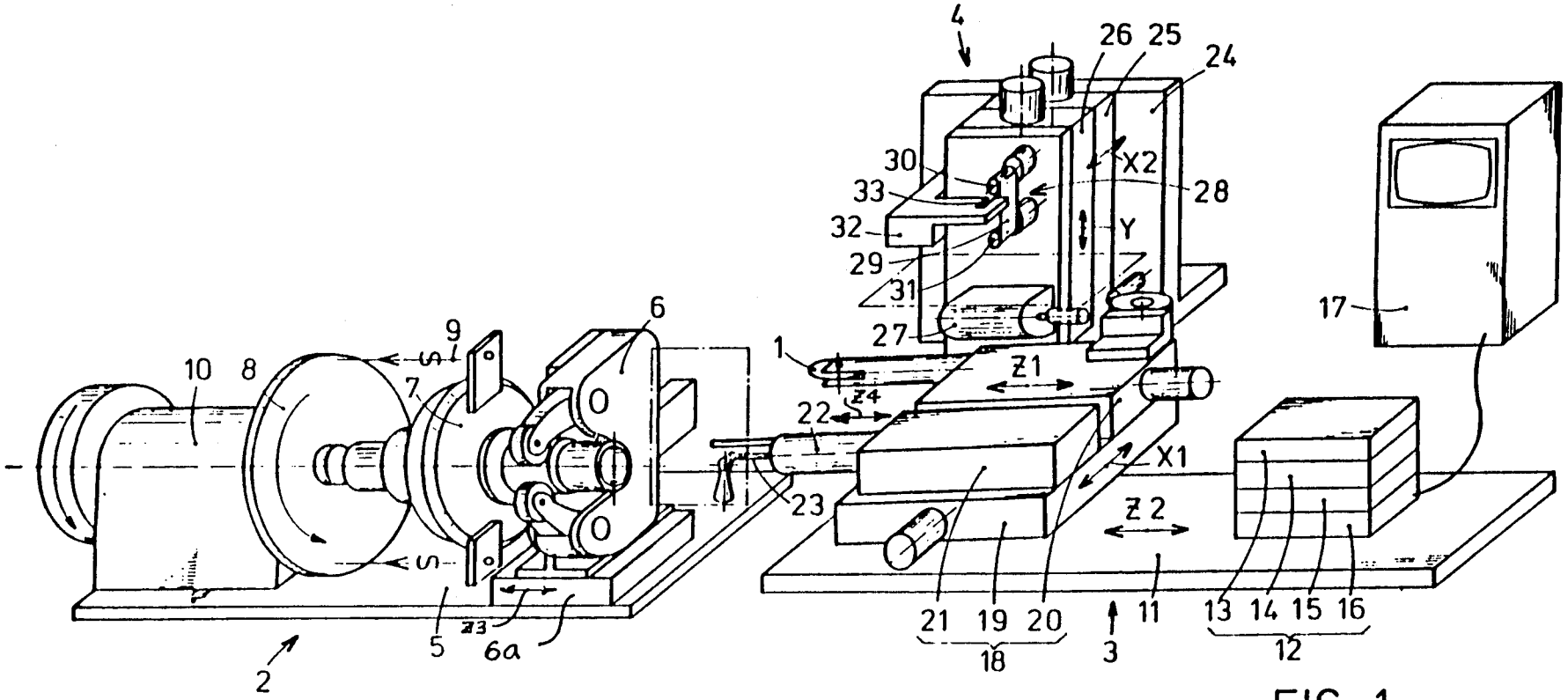
FIG. 1 is a schematic perspective view of the grinder apparatus according to the invention.

The apparatus according to the invention is schematically illustrated in FIG. 1 and is particularly intended to finish grind splines or gear teeth in workpieces that are machined to very high tolerances, particularly those workpieces intended for aeronautical usage. The grinding wheel 1 has a grinding profile or contour to carry out the finish grinding which must be frequently checked and sharpened to maintain the precise tolerances required of the workpiece.

The apparatus comprises a workpiece holder assembly 2, a tool holder assembly 3, and a checking and sharpening unit 4 for the grinding wheel 1. The workpiece holder assembly 2 comprises a mounting base 5 on which is mounted a workpiece support 6 for supporting the workpiece 7. An indexing disk 8 is provided along with means 9 for clamping it to the workpiece. The disk 8 is connected in known fashion to rotational drive means 10 to angularly index the workpiece 7 about its longitudinal axis. Workpiece support 6 is mounted on movable table 6*a* which is displaceable in a generally longitudinal direction denoted by the arrow Z3.

The tool holder assembly 3 comprises a mounting base 11 on which is mounted a connection unit 12 connected to sources of electricity, oil, air at 13, 14 and 15 for the grinding machine, and a link 16 to the central control computer unit 17. Also mounted on base 11 a double cross slide 18 of which the lower element 19 may move relative to the base 11 in two orthogonal directions such as longitudinally denoted by the arrow Z2 and transversely indicted by the arrow X1. The lower element 19 supports a carriage 20 displaceable in a direction denoted by arrow having the grinding wheel 1 thereon, and a test device 21 with a measurement pickup 22 which can be retracted and extended in the longitudinal direction denoted by arrow Z4 which bears a feeler gauge 23.

The grinding wheel checking and sharpening unit 4 comprises a support frame 24 having two superposed and crossing slides comprising a first stage 25 which can be displaced in a direction transverse to the grinding machine denoted by arrow X2 and a second stage 26 which may be displaced in a generally vertical direction denoted by the arrow Y. The lower end of second stage 26 bears a grinding wheel sharpener device 27. A support 28 for a metal foil 29 is also attached to the second stage 26 such that the foil 29 extends between two winder rods 30 and 31. The metal foil 29 may be flexible and may be unwound from one of the rods onto the other of the winder rods so as to present a tensioned strip of foil between the two winder rods A support arm 32 is rigidly attached to the checking and sharpening unit 4 and has a checking head 33 which cooperates with the metal foil 29 to check and determine the profile of the impression left in the foil after contact with the grinding wheel 1.

The process according to the invention will now be described with reference to FIGS. 1*a* through 1*g*. The workpiece 7 is mounted on the machine as shown in FIG. 1 which shows the first step in the process which comprises calibrating the geometric feeler 23 connected to the measurement pickup 22

Figure 1A:
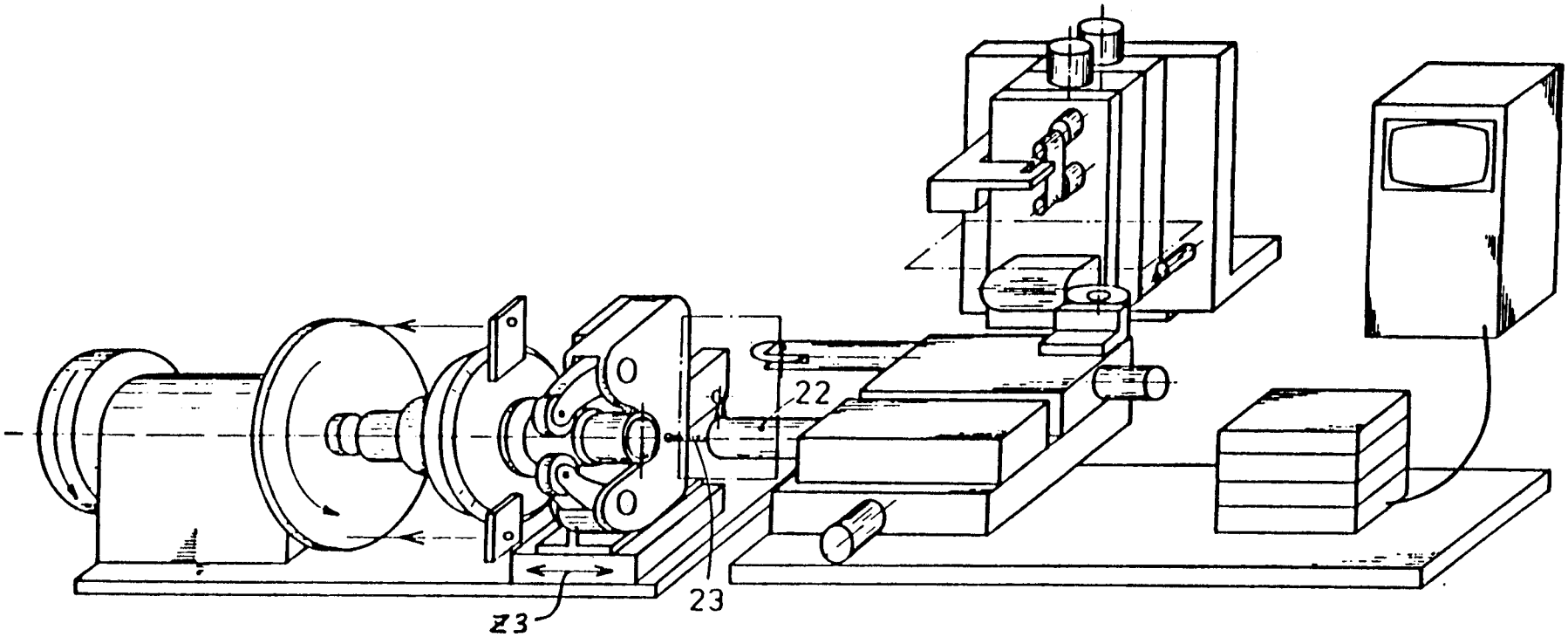
FIGS. 1*a*–1*g* are schematic perspective views of the grinding apparatus illustrated in FIG. 1 showing a sequence of steps for carrying out the grinding process according to the invention.
Figure 1B:
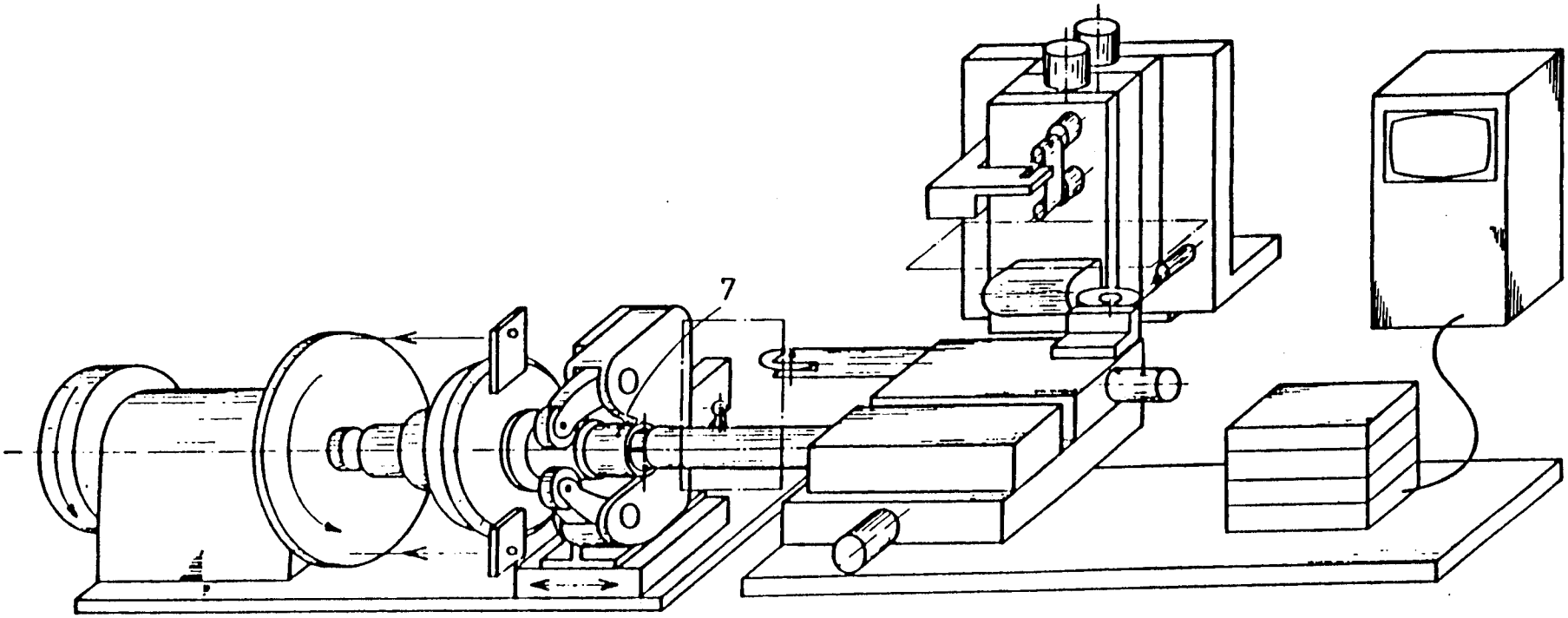

FIG. 1*a* illustrates the next step which comprises measuring the axial position of the workpiece by bringing the feeler 23 into contact with the workpiece. The workpiece is then angularly oriented such that the feeler 23 passes into the spline or between the gear teeth to be ground as shown in FIG. 1*b*.

Figure 1C:
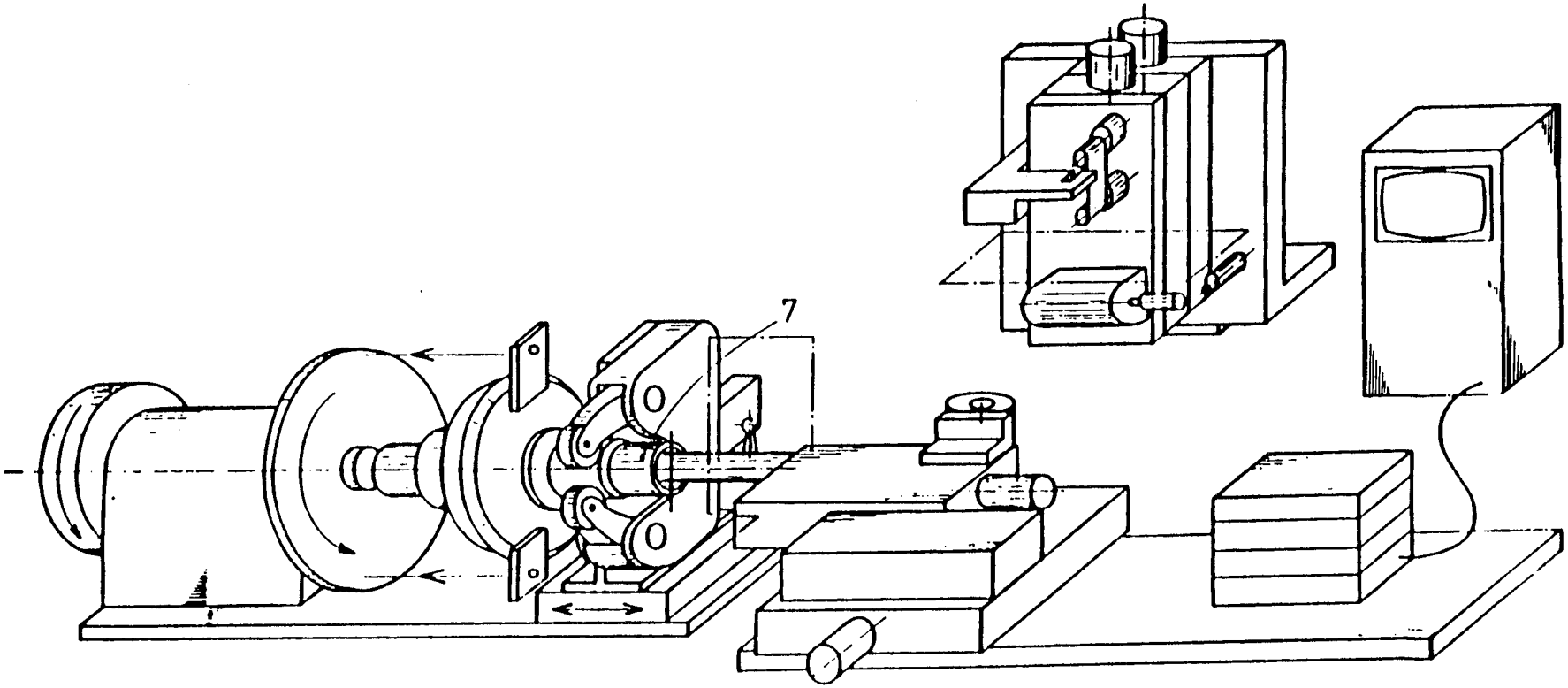

The next step is illustrated by FIG. 1*c* in which the pickup 22 and the feeler 23 have been withdrawn from the workpiece, the element 19 of the cross slide 18 has been displaced in the direction of arrow X1 such that the grinding wheel 1 is in alignment with the interior of the workpiece 7. The grinding wheel 1 is then displaced in the direction of arrow Z1 by movement of the carriage 20 in this direction.

Figure 1D:
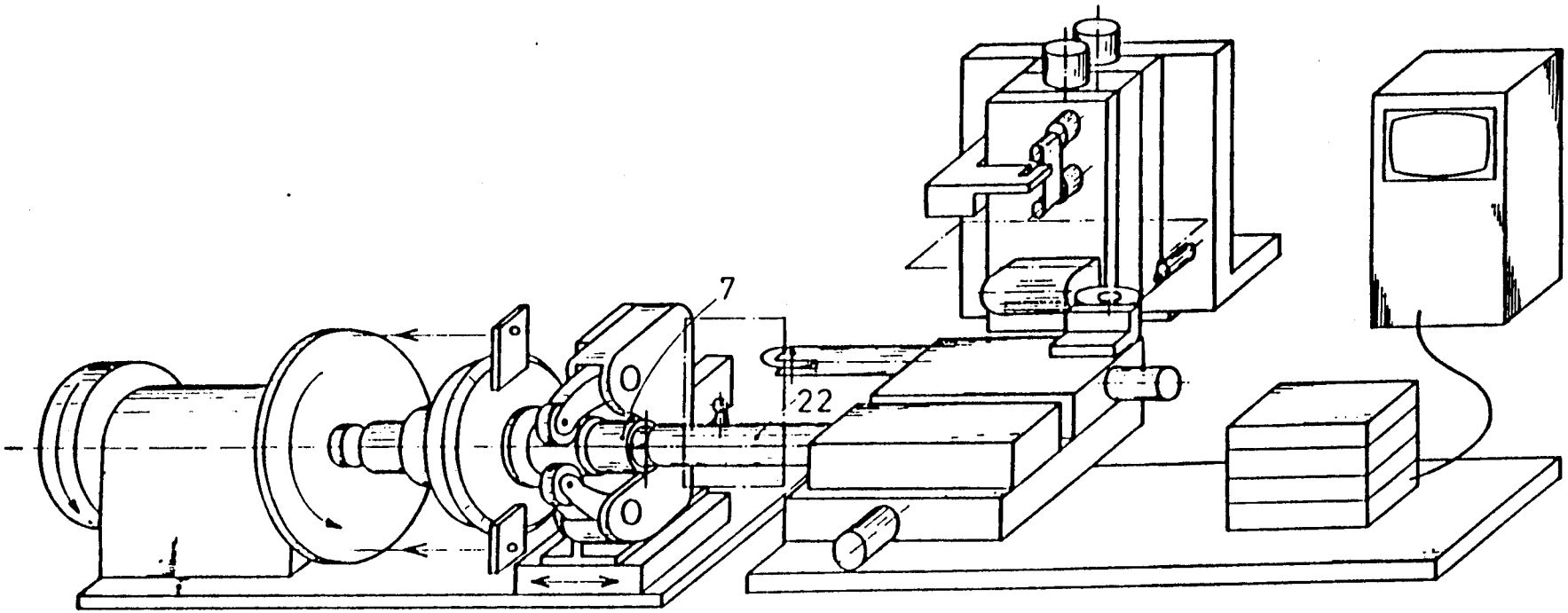

Upon completion of the finish grinding of the spline or gear teeth, the grinding wheel 1 is withdrawn from the workpiece, the lower element 19 is displaced along direction X1 such that the pickup 22 and feeler 23 are once again in alignment with the interior of the workpiece 7. Means are provided in the apparatus to clean the interior of the workpiece to flush out any grinding debris that may remain. Following the cleansing, the pickup 22 along with the feeler 23 is moved along arrow Z4 to enable the feeler 23 to check the ground spline or gear teeth as illustrated in FIG. 1*d*.

Figure 1E:
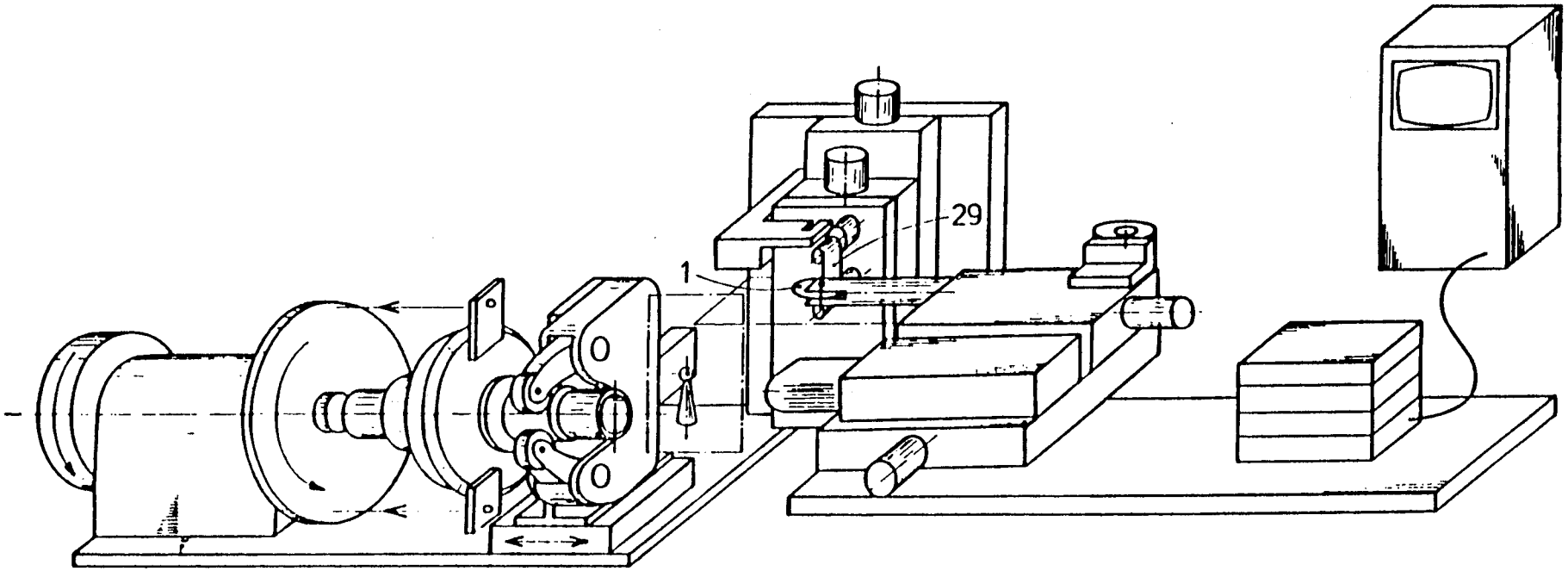
Figure 2:
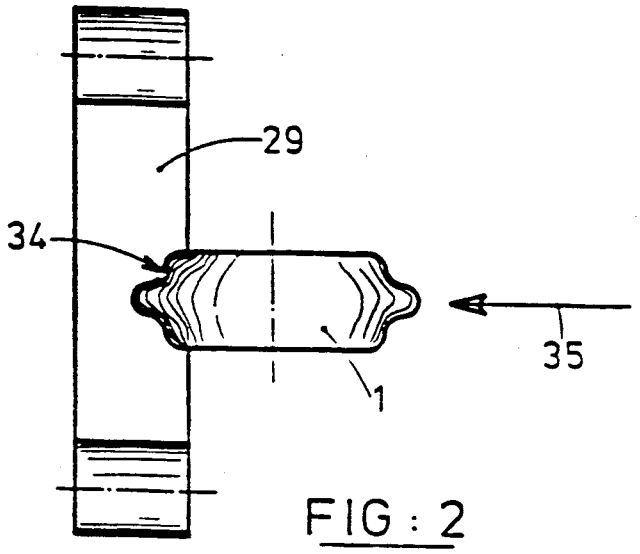
FIG. 2 is a partial, diagrammatical view illustrating the contact between the grinding wheel and the metal foil to leave an impression of the wheel in the foil.

Following such inspection, the pickup 22 and the feeler 23 are withdrawn from the workpiece and the grinding wheel 1 is brought in to contact with the metal foil strip 29 so as to leave an impression of the cross-section of the grinding wheel periphery in an edge of the foil. As illustrated in FIGS. 1*e* and 2, the relative movement between the foil and grinding wheel causes the wheel 1 to move into and edge of the foil in the direction of arrow 35 to leave an impression 34 of the contour of the grinding wheel 1.

Figure 1F:
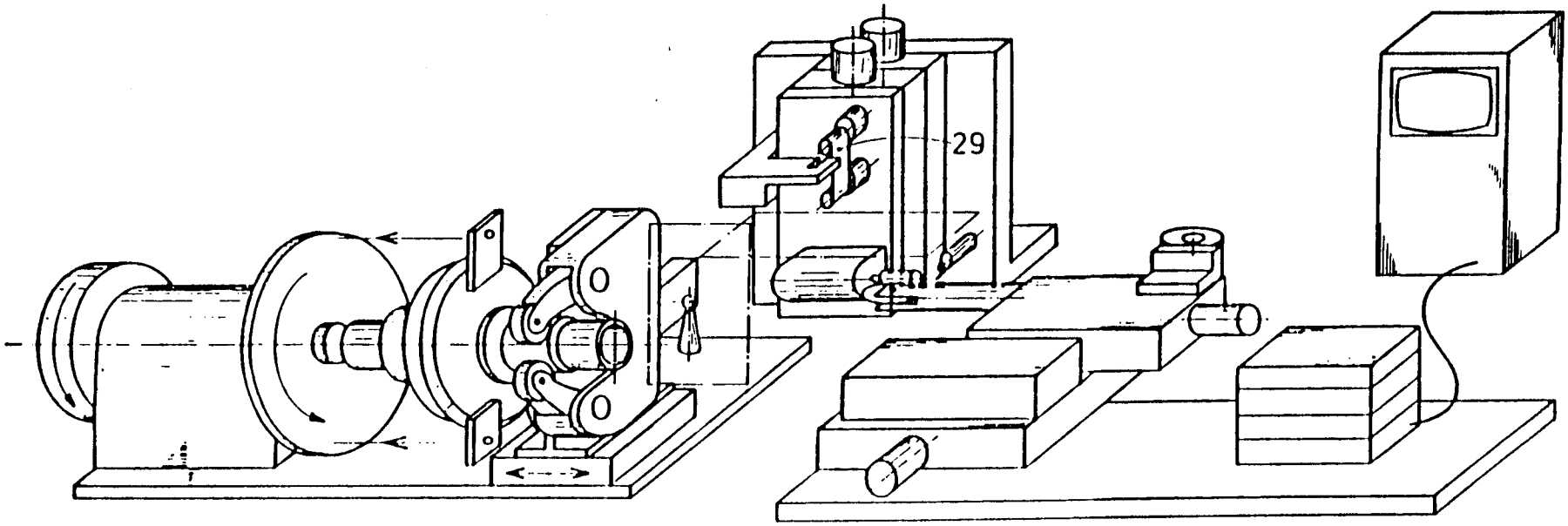

The next step, as illustrated in FIG. 1*f*, involves bringing the checking head 33 in position relative to the metal foil 29 to determine the contour of the impression left on the metal foil and to transmit data relating to this profile to the computer 17.

Figure 1G:
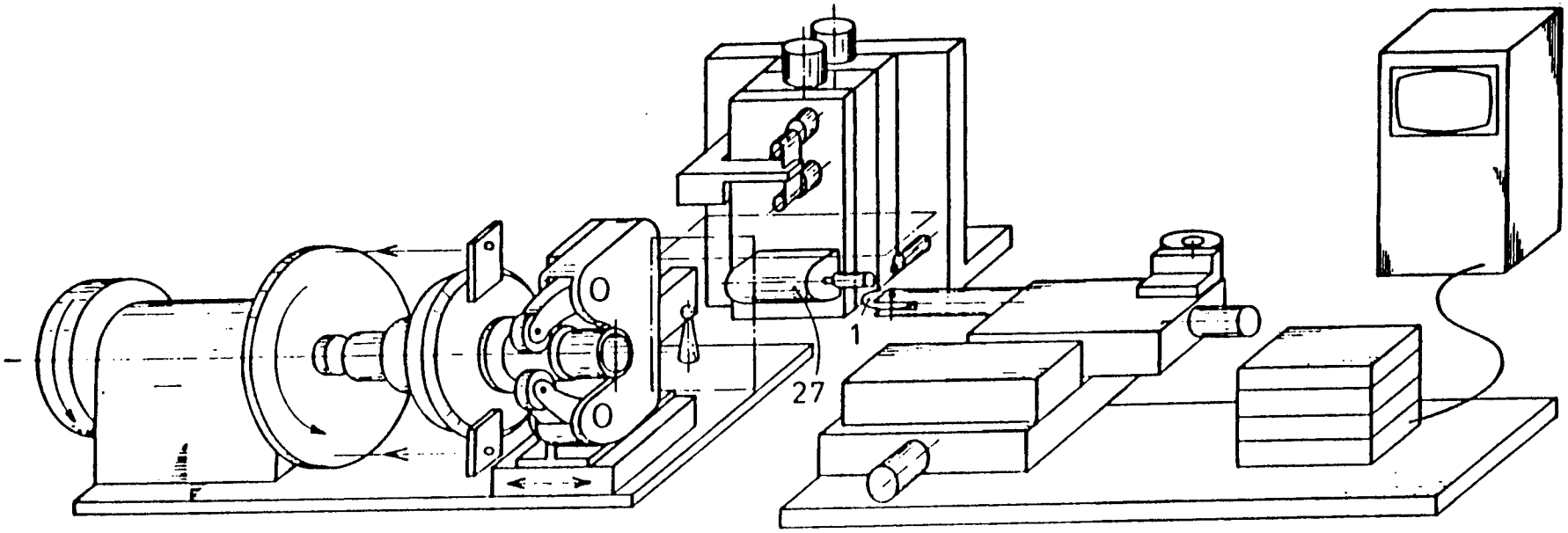

Based upon this data, the computer controls the operation of the sharpener 27 used to sharpen or dress the grinding wheel 1 to ensure that the proper profile of the wheel is maintained as illustrated in FIGS. 1*f* and 1*g*.

The checking head 33 used to check the profile of the impression 34 may take several different embodiments. In a first embodiment, schematically illustrated in FIGS. 3*a*–3*e*, the checking head 33 comprises an optics system 36 having a laser diode 37 and an optical focuser 38 both located on one side of the metal foil. An optical receiver 39, as well as a light sensitive plate 40 are located on an opposite side of the metal foil 29. The light sensitive plate 40 may be of the charge-transfer grid type with a matrix structure.

Figure 3A:
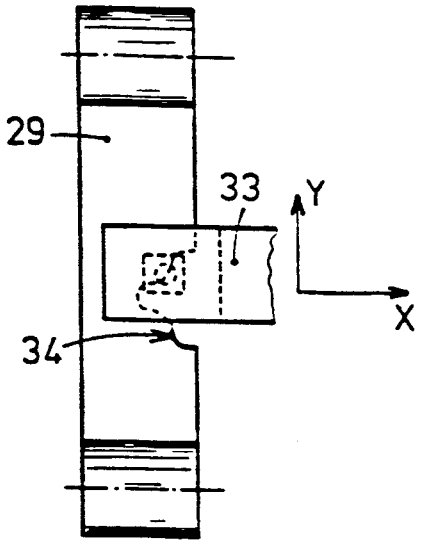
FIG. 3*a* is a partial, front view illustrating a first embodiment of the checking head according to the invention.
Figure 3B:
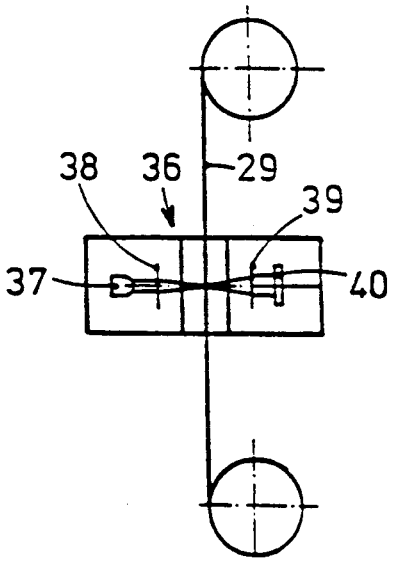
FIG. 3*b* is a side view of the checking head illustrated in FIG. 3*a*.

The checking head 33 may be displaced relative to the metal foil 29 along two orthogonal axes X and Y, as illustrated in FIG. 3*a* wherein the plane of the orthogonal axes is substantially parallel to the plane of the metal foil 29. The displacement of the checking head 33 is controlled by the computer 17 and allows the checking head to follow the contour of the impression 34 made in the metal foil 29 by the grinding wheel 1.

Figure 3C:
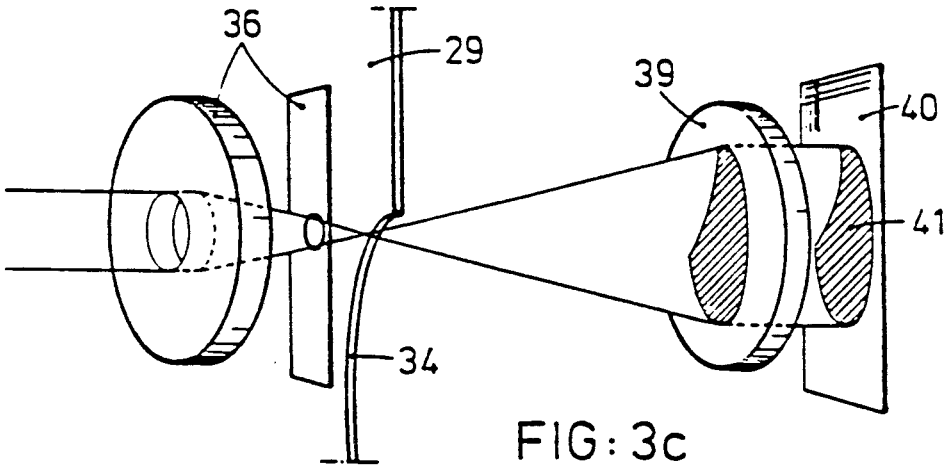
FIG. 3*c* is a partial, perspective diagram illustrating the operation of the checking head shown in FIGS. 3*a* and 3*b*.
Figure 3E:
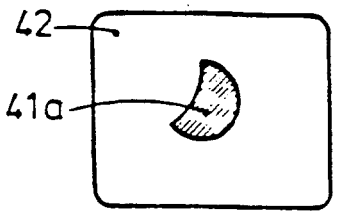
FIG. 3*d* is a partial, front view illustrating the relationship between the profile contour of the metal foil and the light sensitive plate.
Figure 3D:
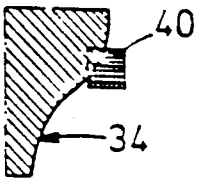

As best illustrated in FIG. 3*c*, the image of the luminous spot 41 falls on the light sensitive grid plate 40 which, in known fashion, transmits data relating to this image in digital form to the computer 17. The profile is reproduced at 41*a* on the computer screen 42 as illustrated in FIG. 3*e*. The computer also processes the image and the analysis of the impression to provide geometric data relating to the coordinates of the profile of the grinder wheel 1. These data are integrated by the computer 17 into the control program of the grinding machine and serve as references to carry out the automatic sharpening and dressing of the grinding wheel, the new geometric dimensions of the grinding wheel then being taken into account for the ensuing grinding operation.

Figure 4A:
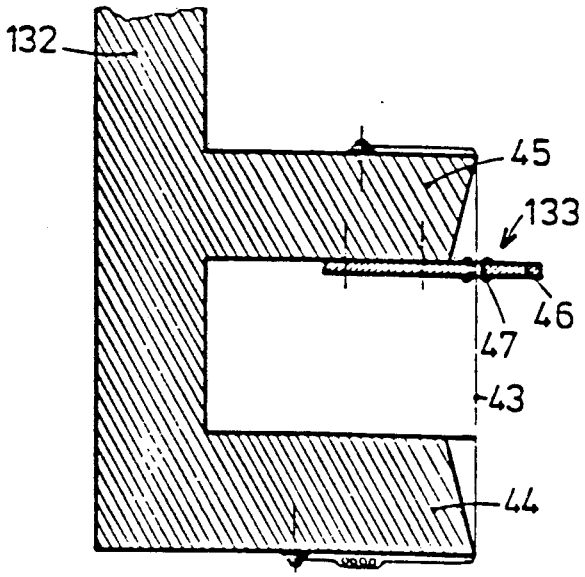
FIG. 4*a* is a partial, top view of a second embodiment of the checking head.
Figure 4B:
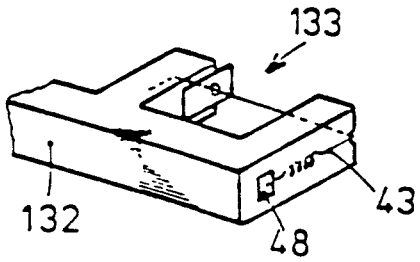
FIG. 4*b* is a partial, perspective view of the checking head shown in FIG. 4*a*.
Figure 5:
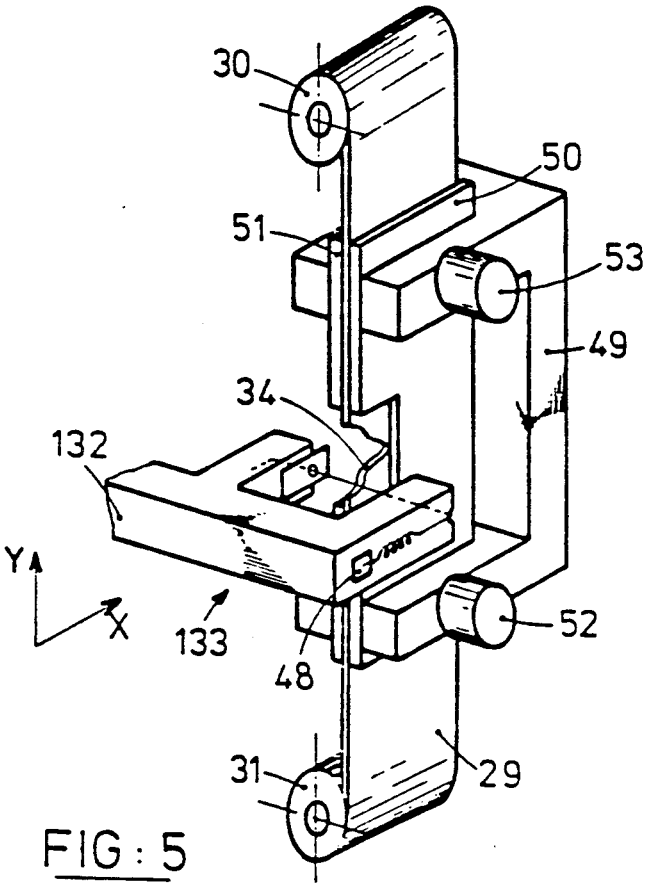
FIG. 5 is a partial, perspective view illustrating the relationship between the checking head shown in FIGS. 4*a* and 4*b* to the metal foil.
Figure 6:
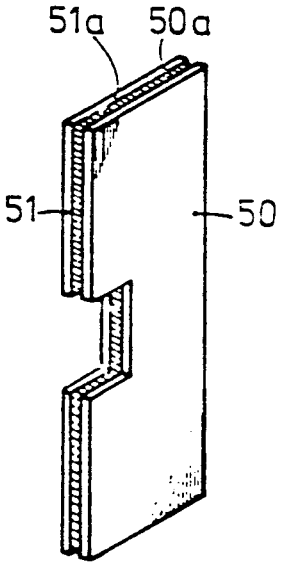
FIG. 6 is a partial, perspective view illustrating the clamping plates utilized in FIG. 5.

A second embodiment of the checking head used to check the contour of the impression 34 is illustrated in FIG. 4, 5 and 6. Components the same as those used in the first embodiment are denoted by the same references, while similar components are denoted by their numbers increased by 100. Thus, the checking head 133 comprises a support arm 132 made of electrically insulating material (such as bakelite) which is joined to the checking and sharpening unit 4 and can be displaced along two orthogonal axes X and Y, as shown in FIG. 5. The checking head 133 has an electrically conducting wire 43 extending between two spaced apart fingers 44 and 45 protruding from the arm 132. A small plate 46 is mounted to one of the arms and has a metallized hole 47 through which the wire 43 passes without contacting the periphery of the hole. A voltage source 48 (for instance a five volt source) is mounted on the arm 132 and is electrically connected to the wire 43 so as to generate a voltage therein.

The metal foil 29 tensioned between the support rods 30 and 31 is kept stationary by a clamping device illustrated in FIGS. 5 and 6. The device comprises a holding body 49 having plates 50 and 51 made of electrically non-conducting material (such as epoxy) each having an electrically conductive coating 50*a* and 51*a* (such as copper) on one side such that the coatings contact the metal foil 29. Known electromechanical actuators 52 and 53 located on the holding body on either side of the metal foil 29 urge the plates 50 and 51 into contact with opposite sides of the foil 29.

The arm 132 bearing the checking head 133 is moved until the wire 43 makes contact with the metal foil 29 at a portion of the impression 34. When the wire contacts the foil, the voltage is imparted to the metal foil 29 and to the electrically conductive coatings 50*a* and 51*a* of the plates 50 and 51. The voltage of the plates is sensed by the computer 17 via an electrical conductor extending between the coatings and the interface input 16 of the computer, which records the X and Y coordinates of the arm when the voltage is detected. This action is continued until the profile of the impression has been accurately plotted.

Data regarding the profile of the impression contour, as in the previous embodiment, is used to control the ensuing automatic sharpening of the grinding wheel and also serves as tool reference dimensions in the following grinding operation.

The checking head 133 also includes a safety device to prevent undesired movement into the foil 29. If, for some reason, the electrical potential of the electrically conductive coatings 50*a* and 51*a* is not detected when the wire comes into contact with the metal foil 29, the arm 132 will continue its course of movement advancing into the metal foil 29. This causes the wire 43 to deflect and contact the metallized hole 47 of the plate 46. The computer 17 senses this contact, stops the advancing movement of the arm 132 and indicates that a malfunction has occurred.

Figure 7:
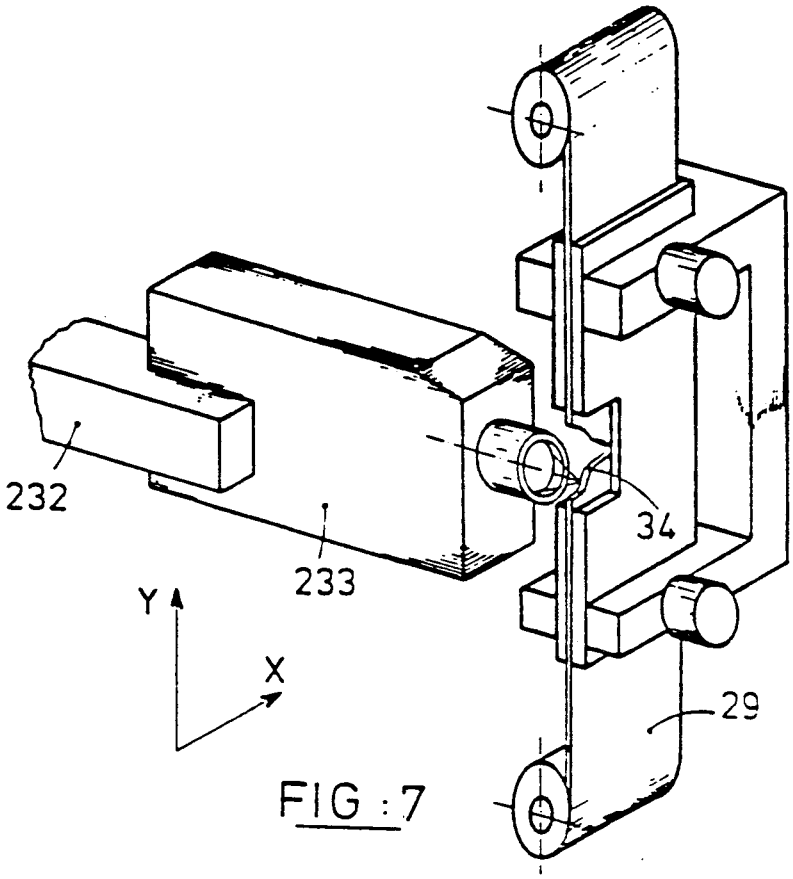
FIG. 7 is a partial, perspective view illustrating a third embodiment of the checking head.
Figure 8:
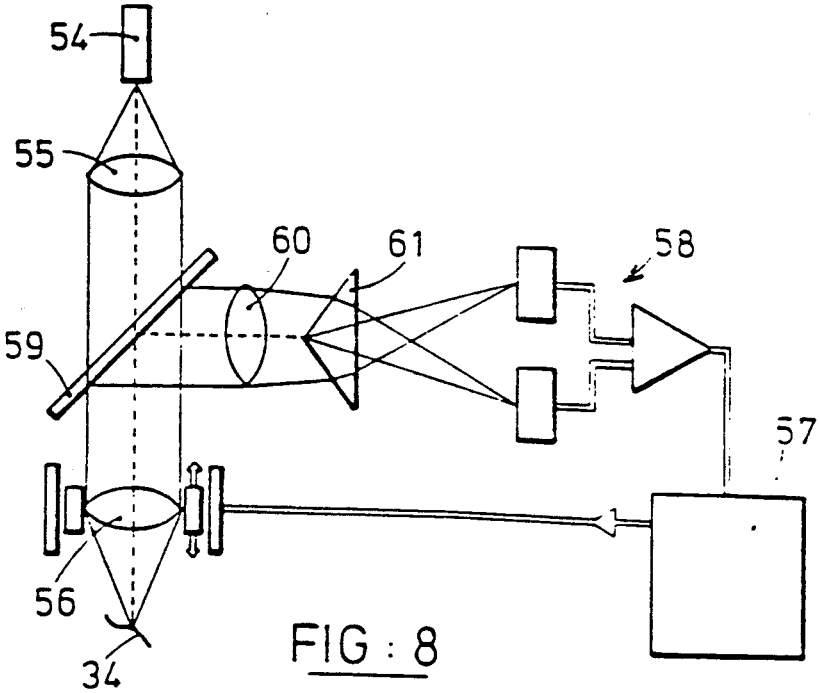
FIG. 8 is a partial, schematic diagram illustrating the components of the checking head system shown in FIG. 7.

As a third alternative, the checking head may comprise a known optical device for determining the profile of the impression contour. This is illustrated in FIGS. 7 and 8 and comprises a checking head 233 of a known optical type, which is mounted on arm 232 in order to plot the profile of the impression 34. The schematic diagram of FIG. 8 illustrates the known principal of such an optical profilometer integrated into the checking head 233 which may be used to check the impression 34. A laser diode 54 emits a beam focused by lenses 55 and 56 onto the impression 34 formed in the metal foil 29. The proper position of the focal point is achieved by displacing lens 56, controlled by unit 57, recording the corresponding test data received from a photo-sensor 58, which signal corresponds to the deviation of the beams through the divider 59, the lens 60 and the prism 51.

The foregoing description is provided for illustrative purposes only and should not be construed as in any way limiting this invention, the scope of which is defined solely by the appended claims.

What is claimed is:

1. A grinding apparatus for finish grinding splines or gear teeth on a workpiece comprising:

a) work holder means to hold the workpiece in a desired position;

b) a tool holder assembly having a grinding wheel movable into and out of contact with the workpiece, the grinding wheel having a peripheral portion with a cross-sectional shape for finish grinding splines or gear teeth on the workpiece;

c) impression means to form an impression of the contour of the peripheral portion of the grinding wheel after contact with the workpiece;

d) a checking head to determine the contour formed on the impression means and generate control data relating to the contour;

e) wheel sharpening means to sharpen the grinding wheel; and, f) computer means connected with the checking head to receive the control data therefrom and connected to the work holder, the tool holder and the sharpening means to control the sharpening of the grinding wheel, the movement of the tool holder and the positioning of the workpiece.

2. The apparatus according to claim 1 wherein the impression means comprises:

a) a metal foil, and, b) means to support the foil in a tensioned condition located such that the grinding wheel contacts an edge portion of the foil to leave an impression of the contour of the grinding wheel.

3. The apparatus according to claim 2 wherein the metal foil is in the form of a band and wherein the support means comprises first and second support rollers such that the band may be unwound from one support roller and wound onto the other support roller.

4. The apparatus according to claim 2 wherein the checking head comprises:

a) a light source located on a first side of the metal foil;

b) a light sensitive plate located on a second side of the metal foil such that a beam of light emanating from the light source and directed onto the metal foil will leave an image of the impression contour on the light sensitive plate.

5. The apparatus according to claim 4 wherein the light sensitive plate comprises a charge transfer grid with a matrix structure.

6. The apparatus according to claim 4 wherein the light source comprises a laser emission diode.

7. The apparatus according to claim 1 further comprising means to move the checking head in generally orthogonal directions in a plane extending generally perpendicular to a path of movement of the grinder wheel when moving it into and out of contact with the workpiece.

8. The grinding apparatus according to claim 2 wherein the metal foil is electrically conducting and wherein the checking head comprises:

a) an arm having a pair of spaced a part fingers;

b) an electrically conductive wire extending between the fingers;

c) a voltage source electrically connected to the wire;

d) means to clamp the metal foil between electrically conducting plates;

e) means to move the arm relative to the metal foil such that the wire may contact the foil in the impression contour;

f) means to detect when a voltage is imparted to the clamping plates; and, g) means to determine the positional coordinates of the wire when a voltage is detected.

9. The apparatus according to claim 8 further comprising:

a) a plate attached to one of the spaced apart fingers defining a hole through which the wire passes such that it is normally out of contact with the plate; and b) means to detect when a voltage is applied to the plate indicating contact between the wire and the plate, said means being connected to the computer means to stop movement of the arm relative to the foil.

* * * * *

UNITED STATES PATENT AND TRADEMARK OFFICE

CERTIFICATE OF CORRECTION

PATENT NO. : 5,072,548

DATED : December 17, 1991

INVENTOR(S) : Girard et al.

It is certified that error appears in the above-identified patent and that said Letters Patent is hereby corrected as shown below:

Col. 2, line 51, change "3a" to --3e--;

Col. 3, line 33, change "indicted" to --indicated--;
line 35, after "arrow" insert --21--.

Signed and Sealed this

Sixteenth Day of November, 1993

*Attest:*

Bruce Lehman

BRUCE LEHMAN

*Attesting Officer*

*Commissioner of Patents and Trademarks*